US006167964B1

(12) United States Patent
Kenter et al.

(10) Patent No.: US 6,167,964 B1
(45) Date of Patent: Jan. 2, 2001

(54) METHOD OF DETERMINING IN-SITU STRESSES

(75) Inventors: Cornelis Jan Kenter; Johannes Gerardus Van Munster; Barend Jan Pestman, all of Rijswijk (NL)

(73) Assignee: Shell Oil Company, Houston, TX (US)

( * ) Notice: Under 35 U.S.C. 154(b), the term of this patent shall be extended for 0 days.

(21) Appl. No.: 09/347,938

(22) Filed: Jul. 6, 1999

(30) Foreign Application Priority Data

Jul. 7, 1998 (EP) ..... 98202274

(51) Int. Cl.[7] ..... E21B 49/02
(52) U.S. Cl. ..... 166/250.01; 73/784
(58) Field of Search ..... 166/250.01, 250.17, 166/308; 73/152.54, 781, 783, 784

(56) References Cited

U.S. PATENT DOCUMENTS

| | | | | |
|---|---|---|---|---|
| 4,107,981 | | 8/1978 | Kanagawa . | |
| 4,918,993 | * | 4/1990 | Hughson | 73/801 |
| 4,981,037 | | 1/1991 | Holbrook . | |
| 5,243,855 | | 9/1993 | Steiger . | |
| 5,253,518 | | 10/1993 | Steiger . | |
| 5,339,679 | | 8/1994 | Ingram . | |
| 5,381,690 | * | 1/1995 | Kanduth et al. | 73/152.54 |
| 5,767,399 | * | 6/1998 | Smith et al. | 73/152.11 |
| 5,967,232 | * | 10/1999 | Rhett | 166/250.1 |

FOREIGN PATENT DOCUMENTS

| | | |
|---|---|---|
| 2927529 | 2/1981 | (DE) . |
| 2663121 | 12/1991 | (FR) . |
| 97/36091 | 2/1997 | (WO) . |

OTHER PUBLICATIONS

B. J. Pestman: "An Acoustic Emission of Damage and Stress—Memory Effects in Sandstone", Mining Sciences & Geomechanics Abstracts, vol. 33, No. 6, Sep. 1996 (1996–09), pp. 585–593.

* cited by examiner

*Primary Examiner*—Frank Tsay

(57) ABSTRACT

A method is provided for determining an in-situ stress of an earth formation subjected to first, second and a third in-situ stresses, wherein a borehole has been drilled into the formation, the borehole containing a borehole fluid inducing a selected pressure to the borehole wall so that in a region of the formation the first in-situ stress is replaced by another stress depending on the selected pressure induced to the borehole wall.

5 Claims, 2 Drawing Sheets

Fig.1.
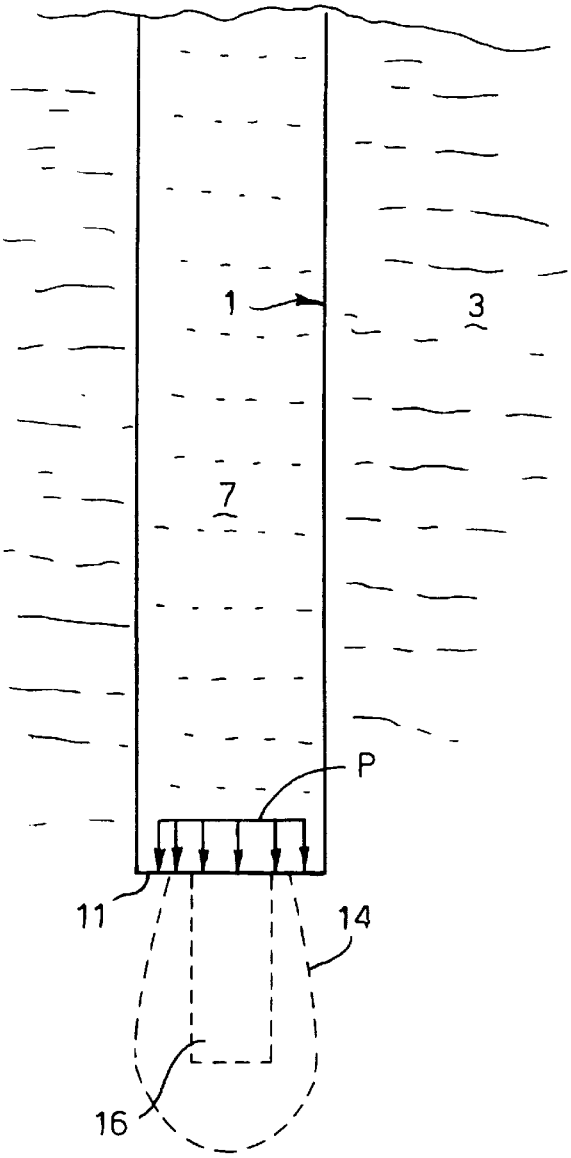
Fig.1A.
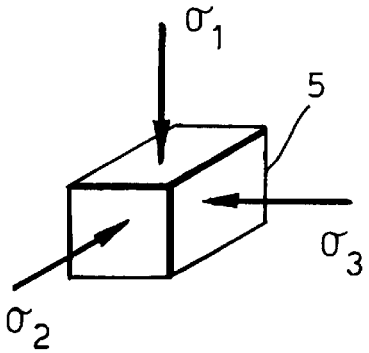
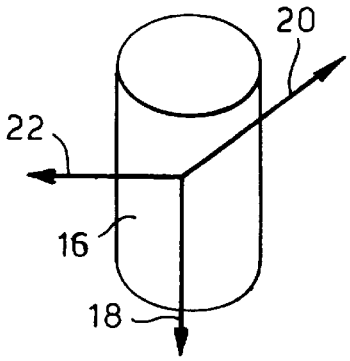
Fig.1B.

METHOD OF DETERMINING IN-SITU STRESSES

FIELD OF THE INVENTION

The present invention relates to a method of determining an in-situ stress of an earth formation, the formation being subjected to an in-situ stress state with a first, a second and a third principal stress. The three principal stresses are generally referred to as the first, the second and the third in-situ stress.

BACKGROUND OF THE INVENTION

In the technology of hydrocarbon production from an earth formation it is often required to know the magnitudes and directions of the in-situ stresses in the formation, or at least to have an indication thereof. Such knowledge is needed, for example, for the purpose of achieving wellbore stability, conducting hydraulic fracturing of the formation, geological modelling or preventing sand production. The direction of the in-situ stresses can be determined in several manners such as differential strain analysis, various acoustic techniques, or so-called minifrac tests. In this respect it is to be understood that one of the in-situ stresses is generally in vertical direction and its magnitude is determined from the weight of the overburden. Therefore, in general only the two horizontal in-situ stresses are subject of investigation with respect to direction and magnitude. It has been tried to determine the magnitudes of the horizontal in-situ stresses by measuring strains and using constitutive properties of the rock to determine the stresses. However, the constitutive properties of the rock are generally not accurately known.

It is therefore an object of the invention to determine more accurately the magnitude of one or more of the in-situ stresses in the earth formation.

SUMMARY OF THE INVENTION

In accordance with the invention there is provided a method of determining an in-situ stress of an earth formation subjected to first, second and a third in-situ stresses, wherein a borehole has been drilled into the formation, the borehole containing a borehole fluid inducing a selected pressure to the borehole wall so that in a region of the formation the first in-situ stress is replaced by another stress depending on said selected pressure induced to the borehole wall, the method comprising the steps of:

selecting a sample which has been removed from said region, the sample having first, second and third reference directions which coincide with the respective directions of the first, second and third in-situ stresses prior to removal of the sample from the formation; and conducting a plurality of tests on the sample whereby in each test the sample is subjected to selected stresses in the reference directions so as to determine a damage envelope of the sample and to determine from the damage envelope at least one of the second and third in-situ stresses, wherein the magnitude of the selected stress in the first reference direction is substantially equal to the magnitude of said another stress.

BRIEF DESCRIPTION OF THE DRAWINGS

FIG. 1 schematically shows a cross-section of a borehole formed in an earth formation, as used in the method of the invention;

FIG. 1A schematically shows the in-situ stresses present in the earth formation;

FIG. 1B schematically shows a core sample taken from the earth formation.

DETAILED DESCRIPTION

Figure 2:
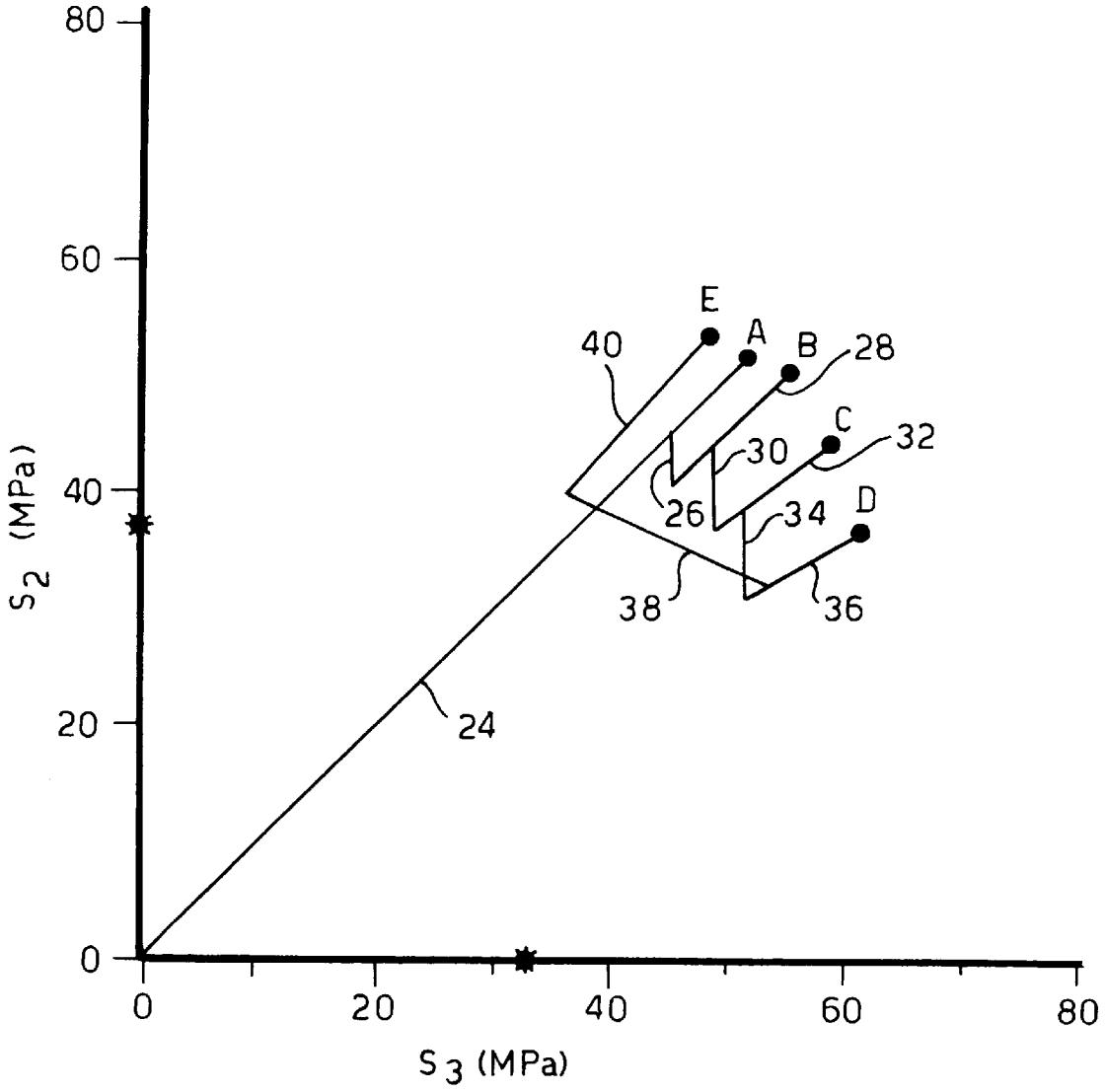
FIG. 2 schematically shows an in-situ stress diagram used in an embodiment of the method of the invention.

It is to be understood that in the context of the present invention the borehole wall includes both the cylindrical part of the borehole wall and the bottom of the borehole. An important aspect of the invention is that account is taken of the severest stress state to which the sample material has been subjected in order to determine the damage envelope. By "severest stress state" is meant the stress state at which the sample material has undergone the largest amount of damage. For example, if the sample is taken from the borehole bottom, the severest stress state is considered to occur just before removing the sample from the formation whereby the magnitude of the vertical in-situ stress at the location of the sample is replaced by a vertical stress equal to the borehole fluid pressure at the borehole bottom plus the weight of the rock material between the borehole bottom and the location of the sample. If the rock material contains pore fluid, the pore fluid pressure is to be deduced from said vertical stress to find the effective vertical stress (which is the stress carried by the rock grains).

In such severest stress state the ratio of the difference between the horizontal in-situ stresses and the vertical stress, to the mean stress is at a maximum.

The damage envelope (also referred to as the damage surface) is formed by the points in three-dimensional stress space at which the onset of additional damage occurs upon further loading of the sample material. The damage surface can be accurately determined from acoustic emission by the sample material at the onset of additional damage. Such acoustic emission is generally referred to as the Kaiser effect as, for example, described in "An acoustic emission study of damage development and stress-memory effects in sandstone", B J Pestman et al, Int. J. Rock Mech. Min. Sci. & Geomech. Abstr., Vol. 33, No. 6, pp. 585–593, 1996.

The invention will be described hereinafter in more detail and by way of example with reference to the accompanying drawings.

In the detailed description below it is assumed that the earth formation contains no pore fluid, hence the stresses referred to are effective stresses carried by the rock grains. FIG. 1 shows a borehole 1 formed in an earth formation 3. The undisturbed formation 3 is subjected to in-situ stresses in vertical and horizontal direction, i.e. a vertical compressive stress $\sigma_1$ and two horizontal compressive stresses $\sigma_2$, $\sigma_3$ as shown in FIG. 1A in relation to a cube-shaped element 5 of the formation 3. The borehole 1 is filled with a drilling fluid 7 of selected specific weight such that a vertical pressure P is exerted by the drilling fluid 7 on the borehole bottom 11. Below the borehole bottom 11 is a region 14 of the formation 3 in which the vertical in-situ stress $\sigma_1$ at a specific point is replaced by a stress $\sigma_1'$ equal to the vertical pressure P from the drilling mud 7 plus the weight of the rock material between the borehole bottom 11 and the specific point. The horizontal in-situ stresses $\sigma_2$, $\sigma_3$ in region 14 are not (or only very little) affected by the presence of the borehole.

A coring tool (not shown) is lowered through the borehole 1 to take a cylindrical core sample 16 (FIG. 1B) from region 14 of the formation 3. In FIG. 1 the core sample 16 is indicated in dotted lines to show the location of the rock material of the core sample 16 prior to taking the sample 16 from the formation 3. The core sample 16 has a first reference direction 18, a second reference direction 20 and a third reference direction 22, which reference directions correspond to the respective in-situ stress directions prior to removal of the sample 16 from the formation 3. Thus, prior to removal of the sample 16 from the formation 3, reference direction 18 corresponds to vertical, reference direction 20 corresponds to the direction of in-situ stress $\sigma_2$ and reference direction 20 corresponds to the direction of in-situ stress $\sigma_3$. During and after removal of the core sample 16 from the formation 3 the compressive stresses acting in the reference directions are altered when the core sample 16 is stored in a container (not shown) containing a fluid at a moderate hydrostatic pressure.

In a next step a series of pressure tests are carried out on the core sample 16 whereby the sample is subjected to compressive stresses $S_1$, $S_2$, $S_3$ in respective reference directions 18, 20, 22. The purpose of the tests is to determine the amount of damage which the material of the core sample 16 has undergone prior to removal from the earth formation 3 and to estimate the horizontal in-situ stresses therefrom. The amount of damage can be represented by a damage envelope in three-dimensional stress space ($S_1$, $S_2$, $S_3$). Considering that the amount of damage of the sample material is determined by the severest stress state to which the sample material has been subjected (i.e. the stress state causing the largest amount of damage) it is an important aspect of the invention that it is taken into account that the severest stress state of the sample material occurred in the presence of the borehole 1 and prior to removing the sample 16 from the formation. Therefore in the severest stress state the principal stresses are $\sigma_1'$ in reference direction 18, $\sigma_2$ in reference direction 20 and $\sigma_3$ in reference direction 22.

With reference to FIG. 2, the profile of the damage envelope for $S_1=\sigma_1'$ is then determined in a series of tests to estimate the magnitudes of horizontal in-situ stresses $\sigma_2$ and $\sigma_3$. During the tests the compressive stress $S_1$ is kept equal $\sigma_1'$, while stresses $S_2$ and $S_3$ are varied until the onset of additional damage occurs. In the example diagram of FIG. 2 the sample 16 is loaded along stress path 24 to point A at which the onset of additional damage occurs. Such onset of additional damage is determined by measuring acoustic emission from the material, based on the Kaiser effect. Next the stresses $S_2$ and $S_3$ are changed along stress paths 26, 28 to point B, along stress paths 28, 30, 32 to point C, along stress paths 32, 34, 36 to point D, and along stress paths 36, 38, 40 to point E, whereby the points B, C, D, E are determined by the onset of additional damage in accordance with the Kaiser effect. The curve formed by points A, B, C, D, E make up the profile of the damage surface for $S_{1a=o1}'$. In conducting the tests, care is to be taken that the severest stress state of the sample material is not exceeded to a significant extent in order to ensure that the damage profile as determined from the tests accurately represents the severest stress state which occurred before the sample 16 was removed from the formation 3.

The damage profile in the $S_1$, $S_2$ diagram (for $S_1=\sigma_1'$) forms a set of points ($S_1$, $S_2$) of which each point could, in principle, represent the in-situ stress state ($\sigma_1$, $\sigma_2$, $\sigma_3$). A selection is made in a known manner to determine from these points the real in-situ stress state, for example by taking a vertex point in the profile as being representative for the real in-situ stresses state.

In case the rock material contains pore fluid, the total stress at a specific point in the formation is the sum of the effective stress (carried by the rock grains) and the pore fluid pressure. The above method then can be applied in a similar manner for the effective in-situ stresses $\sigma_{1e}$, $\sigma_{2e}$ and $\sigma_{3e}$. The vertical effective in-situ stress $\sigma_{1e}$ at a specific point is replaced by a stress $\sigma_{1e}'$ equal to the vertical pressure P from the drilling mud 7 plus the weight of the rock material between the borehole bottom 11 and the specific point minus the pore fluid pressure. The magnitudes of the horizontal effective in-situ stresses $\sigma_{2e}$ and $\sigma_{3e}$ are then determined in a similar manner as described above with reference to $\sigma_2$ and $\sigma_3$.

We claim:

1. A method of determining an in-situ stress of an earth formation subjected to first, second and a third in-situ stresses, wherein a borehole has been drilled into the formation, the borehole containing a borehole fluid inducing a selected pressure to the borehole wall so that in a region of the formation the first in-situ stress is replaced by another stress depending on said selected pressure induced to the borehole wall, the method comprising the steps of:

selecting a sample which has been removed from said region, the sample having first, second and third reference directions which coincide with the respective directions of the first, second and third in-situ stresses prior to removal of the sample from the formation; and conducting a plurality of tests on the sample whereby in each test the sample is subjected to selected stresses in the reference directions so as to determine a damage envelope of the sample and to determine from the damage envelope at least one of the second and third in-situ stresses, wherein the magnitude of the selected stress in the first reference direction is substantially equal to the magnitude of said another stress.

2. The method of claim 1, wherein the direction of the first in-situ stress is substantially vertical, and the directions of the second and third in-situ stresses are substantially horizontal.

3. The method of claim 2, wherein said region is below the borehole bottom and said primary stress is defined by the weight of the fluid column in the borehole and the weight of the part of the earth formation between the borehole bottom and the location where the sample is removed from the formation.

4. The method of claim 1, wherein said sample has been removed from the bottom region of the borehole.

5. The method of claim 1, wherein in each test a point of the damage envelope is determined from acoustic emission from the sample.

* * * * *